US010563378B2

(12) United States Patent
Moriki et al.

(10) Patent No.: US 10,563,378 B2
(45) Date of Patent: Feb. 18, 2020

(54) HYDRAULIC SYSTEM FOR WORK MACHINES

(71) Applicant: HITACHI CONSTRUCTION MACHINERY CO., LTD., Tokyo (JP)

(72) Inventors: Hidekazu Moriki, Mito (JP); Shinya Imura, Toride (JP); Shiho Izumi, Hitachinaka (JP); Hiroaki Amano, Kasumigaura (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 210 days.

(21) Appl. No.: 15/554,536

(22) PCT Filed: Sep. 25, 2015

(86) PCT No.: PCT/JP2015/077188
§ 371 (c)(1),
(2) Date: Aug. 30, 2017

(87) PCT Pub. No.: WO2017/051483
PCT Pub. Date: Mar. 30, 2017

(65) Prior Publication Data

US 2018/0058042 A1 Mar. 1, 2018

(51) Int. Cl.
*E02F 9/22* (2006.01)

(52) U.S. Cl.
CPC ..... *E02F 9/2264* (2013.01); *E02F 9/2203* (2013.01); *E02F 9/2235* (2013.01); *E02F 9/2267* (2013.01); *F15B 2211/6652* (2013.01)

(58) Field of Classification Search
CPC ..... E02F 9/2235; F15B 2211/6652
See application file for complete search history.

(56) References Cited

U.S. PATENT DOCUMENTS 6,020,651 A * 2/2000 Nakamura ..... E02F 9/2235 290/40 R
2007/0271913 A1 11/2007 Ikeda
(Continued)

FOREIGN PATENT DOCUMENTS

EP 1 512 798 A1 3/2005
JP 2002-005109 A 1/2002
(Continued)

OTHER PUBLICATIONS

International Preliminary Report on Patentability received in corresponding International Application No. PCT/JP2015/077188 dated Apr. 5, 2018.
(Continued)

*Primary Examiner* — F Daniel Lopez
(74) *Attorney, Agent, or Firm* — Mattingly & Malur, PC

(57) ABSTRACT

A hydraulic system for a work machine includes a first hydraulic pump driving a swing hydraulic motor; a second hydraulic pumps driving a boom cylinder; a first pump displacement increase valve controlling a volume of the first hydraulic pump; a swing pilot pressure sensor detecting a swing operation amount; a boom raising pilot pressure sensor detecting a boom raising operation amount; and a controller controlling a control signal to the first pump displacement increase valve on the basis of the swing operation amount and the boom raising operation amount. The controller controls the control signal in such a manner that a delivery rate of the first hydraulic pump becomes higher as the swing operation amount is larger and an increasing rate of the delivery rate of the first hydraulic pump becomes lower as the boom raising operation amount is larger during a swing boom raising operation.

3 Claims, 6 Drawing Sheets

(56) References Cited

U.S. PATENT DOCUMENTS

| | | | | |
|---|---|---|---|---|
| 2012/0324875 | A1* | 12/2012 | Edler | E02F 9/123 60/327 |
| 2016/0251833 | A1 | 9/2016 | Kondo et al. | |

FOREIGN PATENT DOCUMENTS

| | | | |
|---|---|---|---|
| JP | 2004-036865 | A | 2/2004 |
| JP | 2008-038587 | A | 2/2008 |
| JP | 2013-181286 | A | 9/2013 |
| JP | 2015-86959 | A | 5/2015 |

OTHER PUBLICATIONS

International Search Report of PCT/JP2015/077188 dated Nov. 10, 2015.
Extended European Search Report received in corresponding European Application No. 15904740.6 dated Jun. 3, 2019.

* cited by examiner

HYDRAULIC SYSTEM FOR WORK MACHINES

TECHNICAL FIELD

The present invention relates to a hydraulic system for a work machine such as a hydraulic excavator.

BACKGROUND ART

A work machine such as a hydraulic excavator can exhibit excellent combined operability by connecting a boom directional control valve and a swing directional control valve to the same pump line in parallel and driving a swing motor and a boom cylinder by a common pump. The "excellent combined operability" means a characteristic that, in a case of, for example, a so-called swing boom raising operation for simultaneously implementing swing and boom raising, a swing acceleration becomes lower as a boom raising operation amount is larger, compared with a case of a sole swing operation. This characteristic results from the higher inertia of a swing structure than the inertia of a boom, and the characteristic is obtained since a swing load pressure is higher than a boom load pressure at initial swing to allow a more hydraulic fluid to flow into the boom cylinder. Under this characteristic, if a swing distance is short relative to a height of a soil discharge position, a boom raising speed increases but a swing increasing rate decreases as the boom raising operation amount is larger, so that the soil discharge position is advantageously easy to adjust during gravel loading work or the like. On the other hand, if the boom load pressure differs from the swing load pressure, a divergence loss can be generated in response to a difference in the load pressure.

Meanwhile, there is known a work machine configured such that a swing motor and a boom cylinder are driven by different pumps and that a swing speed decreases during a swing boom raising operation (refer to Patent Document 1 and the like). Specifically, the work machine is configured such that a delivery rate control valve for controlling a delivery rate of each pump is used to cause a delivery pressure of the pump corresponding to the boom cylinder to act on the delivery rate control valve of the pump corresponding to the swing motor when a boom raising operation is detected, and to decrease a supply flow rate for the swing motor at a time of a swing boom raising operation.

PRIOR ART DOCUMENT

Patent Document

Patent Document 1: JP-2004-36865-A

SUMMARY OF THE INVENTION

Problem to be Solved by the Invention

However, the hydraulic system of Patent Document 1 does not always simultaneously achieve the abovementioned excellent combined operability and the reduction of loss. The reason is as follows. The configuration of the hydraulic system of Patent Document 1 is to simply turn on or off a command pressure to the delivery rate control valves depending on whether the boom raising operation is present, and not to cause the swing speed to decrease in proportion to a boom raising operation amount during the swing boom raising operation. For achieving the excellent combined operability, the hydraulic system of Patent Document 1 needs to control, for example, the delivery rate control valves in such a manner as to suppress a flow rate to be supplied to the swing motor as the boom raising operation amount is larger, and to supply a higher flow rate to the boom cylinder. In this case, however, the pressure loss increases between the hydraulic pump and the boom cylinder, resulting in the degradation of fuel economy.

An object of the present invention is to provide a hydraulic system for a work machine capable of realizing excellent combined operability while suppressing a divergence loss during a swing boom raising operation and suppressing degradation of fuel economy.

Means for Solving the Problem

To attain the object, a hydraulic system for a work machine according to the present invention is a hydraulic system for a work machine including a track structure, a swing structure swingably mounted on the track structure, and a work device that includes a boom attached to the swing structure, the hydraulic system including: a swing hydraulic motor causing the swing structure to swing; a boom cylinder driving the boom; a first hydraulic pump delivering a hydraulic fluid for driving the swing hydraulic motor; a second hydraulic pump delivering a hydraulic fluid for driving the boom cylinder; a swing operation device instructing an operation of the swing hydraulic motor; a boom operation device instructing an operation of the boom cylinder; a first pump displacement increase valve controlling a volume of the first hydraulic pump; a swing operation amount detector detecting a swing operation amount of the swing operation device; a boom raising operation amount detector detecting a boom raising operation amount of the boom operation device; and a controller controlling a first pump flow control signal that is a command signal to the first pump displacement increase valve on the basis of the swing operation amount detected by the swing operation amount detector and the boom raising operation amount detected by the boom raising operation amount detector. The controller controls the first pump flow control signal in such a manner that a delivery rate of the first hydraulic pump becomes higher as the swing operation amount of the swing operation device is larger and an increasing rate of the delivery rate of the first hydraulic pump becomes lower as the boom raising operation amount of the boom operation device is larger if a swing operation by the swing operation device and a boom raising operation by the boom operation device are performed simultaneously.

Effect of the Invention

According to the present invention, it is possible to realize excellent combined operability while suppressing a divergence loss during a swing boom raising operation and suppressing degradation of fuel economy.

MODES FOR CARRYING OUT THE INVENTION

Embodiments of the present invention will be described hereinafter with reference to the drawings.

1. Work machine

Figure 1:
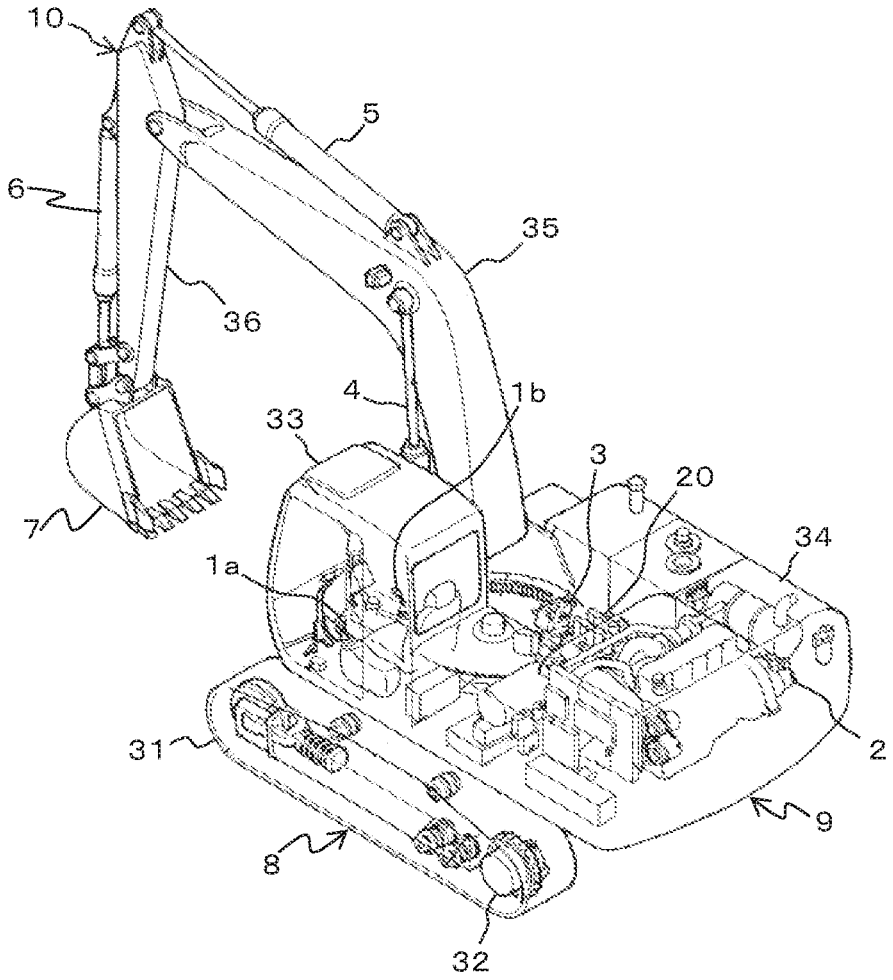
FIG. 1 is a perspective view illustrating an example of a work machine to which a hydraulic system according to an embodiment of the present invention is applied.

FIG. 1 is a perspective view illustrating an example of a work machine to which a hydraulic system according to an embodiment of the present invention is applied. In the following description, it is assumed that a front of a cab seat (in an upper left direction in the drawings) is a front of a body. It is noted, however, that exemplary showing a hydraulic excavator is not intended to limit objects to which the hydraulic system according to the present invention is applied. The hydraulic system according to the present invention is applicable, as needed, to work machines of other types under similar circumstances.

The work machine exemplarily shown in FIG. 1 is a hydraulic excavator, which includes a track structure 8, a swing structure 9 swingably mounted on the track structure 8, and a work device 10 attached to the swing structure 9.

The track structure 8 includes left and right crawlers 31 each having an endless track crawler belt in the present embodiment, and travels by driving the left and right crawlers 31 by left and right travel motors 32, respectively. For example, hydraulic actuators are used as the travel motors 32.

A cab 33 into which an operator gets is provided in a front portion of the swing structure 9. A power chamber 34 accommodating an engine, a hydraulic drive device, and the like is provided in rear of the cab 33 of the swing structure 9. A swing hydraulic motor 3 is provided in a swing frame that couples the swing structure 9 to the track structure 8. Left and right operation levers 1*a* and 1*b* for instructing a swing operation of the swing structure 9 and a operation of the work device 10 are provided in the cab 33. Furthermore, the power chamber 34 accommodates a hydraulic pump device 2 that delivers a hydraulic fluid for driving each hydraulic actuators, a control valve device 20 that controls a flow of the hydraulic fluid supplied from the hydraulic pump device 2 to the hydraulic actuator, and the like.

The work device 10 is coupled to the front portion of the swing structure 9 (a right side of the cab 33 in the present embodiment). The work device 10 is a multijoint work device that includes a boom 35, an arm 36, and a bucket 7. The boom 35 is vertically rotatably coupled to the frame of the swing structure 9 and coupled to the frame of the swing structure 9 via a boom cylinder 4. The arm 36 is rotatably coupled to a tip end of the boom 35 and coupled to the boom 35 via an arm cylinder 5. The bucket 7 is rotatably coupled to a tip end of the arm 36 and coupled to the arm 36 via a bucket cylinder 6. The boom cylinder 4, the arm cylinder 5, and the bucket cylinder 6 are hydraulic actuators.

In the work machine shown in FIG. 1, the hydraulic fluid delivered from the hydraulic pump device 2 is supplied to each of the swing hydraulic motor 3, the boom cylinder 4, the arm cylinder 5, and the bucket cylinder 6 via the control valve device 20 in response to an operation on the left or right operation lever 1*a* or 1*b*. Needless to say, the swing hydraulic motor 3 causes the swing structure 9 to swing, and the boom cylinder 4, the arm cylinder 5, and the bucket cylinder 6 drive the boom 35, the arm 36, and the bucket 7, respectively. A position and a posture of the bucket 7 change by expansion or contraction of the boom cylinder 4, the arm cylinder 5, and the bucket cylinder 6 by the hydraulic fluid. Furthermore, the swing structure 9 swings relatively to the track structure 8 by rotation of the swing hydraulic motor 3 by the hydraulic fluid. A operation of the track structure 8 is not directly related to the present invention and is not, therefore, described.

2. Hydraulic system

Figure 2:
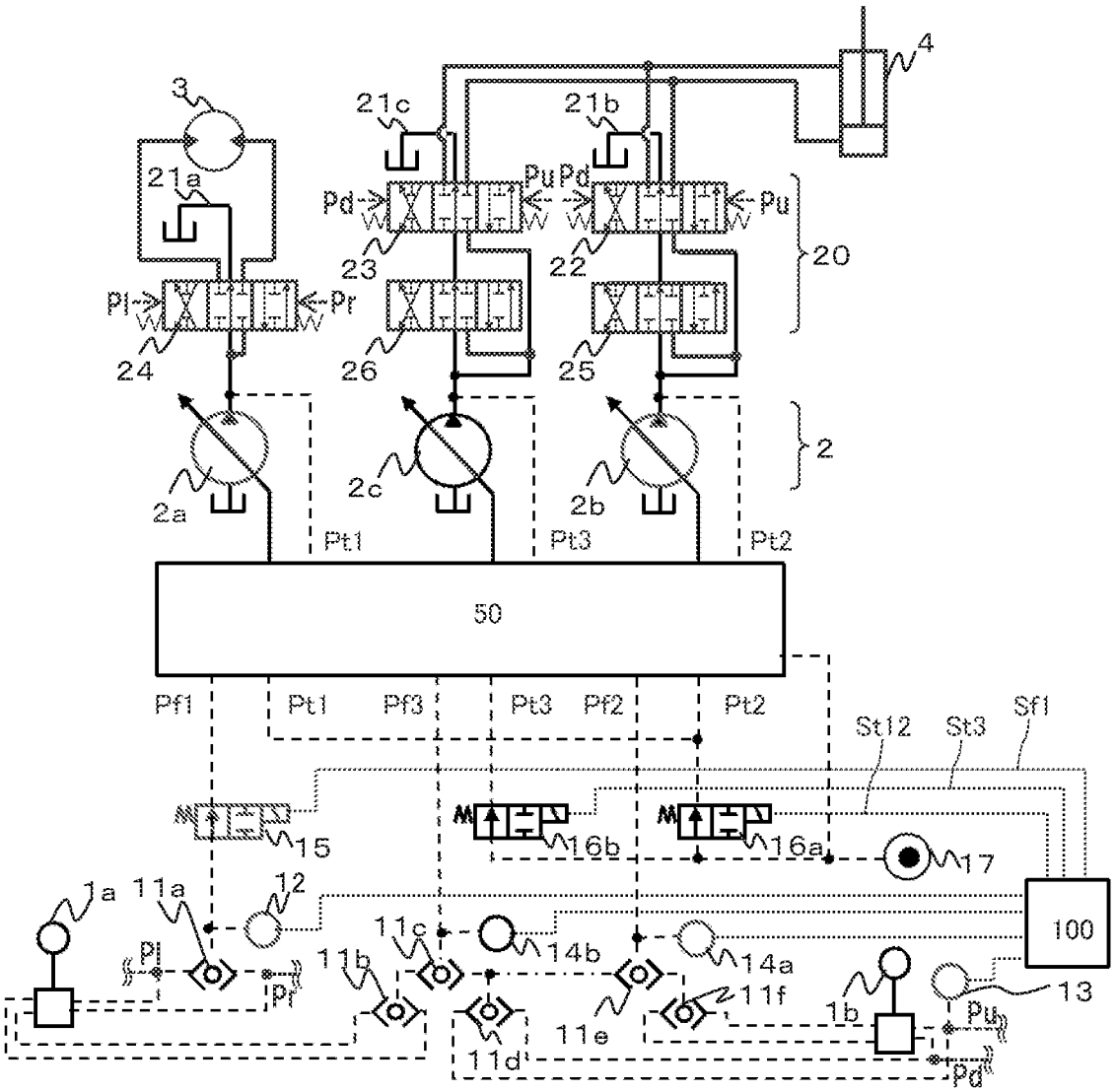
FIG. 2 is a circuit diagram illustrating principal sections of the hydraulic system according to an embodiment of the present invention.

FIG. 2 is a circuit diagram illustrating principal sections of the hydraulic system according to an embodiment of the present invention. The hydraulic system shown in FIG. 2 includes a pilot hydraulic fluid source 17, shuttle valve group, an operation amount detector, a pump control valve, a pump driving device 50, and a controller 100 in addition to the hydraulic pump device 2, the control valve device 20, the left and right operation levers 1*a* and 1*b*, and the hydraulic actuators (such as the swing hydraulic motor 3 and the boom cylinder 4). The constituent elements will be described below.

Hydraulic Pump Device

The hydraulic pump device 2 includes a first hydraulic pump 2*a*, second hydraulic pumps 2*b* and 2*c*, and a pilot hydraulic fluid source 17, and is driven by, for example, an engine that is not shown. The first hydraulic pump 2*a* and the second hydraulic pumps 2*b* and 2*c* are variable displacement hydraulic pumps. While swash plate type hydraulic pumps are described by way of example in the present embodiment, inclined shaft type hydraulic pumps may be used. Moreover, while a case where the hydraulic pump device 2 includes the two second hydraulic pumps is exemplarily shown, the hydraulic pump device 2 often includes one second hydraulic pump. The first hydraulic pump 2*a* delivers the hydraulic fluid for driving the swing hydraulic motor 3 to a first pump line 21*a*. The second hydraulic pumps 2*b* and 2*c* deliver the hydraulic fluids for driving the boom cylinder 4, the arm cylinder 5, and the bucket cylinder 6 to second pump lines 21*b* and 21*c*, respectively. While the arm cylinder 5 and the bucket cylinder 6 are not shown in FIG. 2, the hydraulic fluid delivered from the second hydraulic pump 2*b* is supplied to the bucket cylinder 6 and the hydraulic fluid delivered from the second hydraulic pump 2*c* is supplied to the arm cylinder 5. The hydraulic fluids delivered from the second hydraulic pumps 2*b* and 2*c* are combined to be supplied to the boom cylinder 4.

Control Valve Device

The control valve device 20 includes boom directional control valves 22 and 23, a swing directional control valve 24, a bucket directional control valve 25, and an arm directional control valve 26. In the present embodiment, the control valve device 20 configured to include the two boom directional control valves 22 and 23 is exemplarily shown since the hydraulic pump device 2 is configured such that the hydraulic fluids delivered from the second hydraulic pumps 2*b* and 2*c* are combined to be supplied to the boom cylinder 4. However, the control valve device 20 often includes one boom directional control valve.

The boom directional control valve 22 and the bucket directional control valve 25 are provided in the second pump line 21*b* in series. The boom directional control valve 22 is located downstream of the bucket directional control valve 25. Likewise, the boom directional control valve 23 and the arm directional control valve 26 are provided in the second pump line 21*c* in series. The boom directional control valve 23 is located downstream of the arm directional control valve 26. The swing directional control valve 24 is provided in the first pump line 21*a*. The boom directional control valves 22 and 23 control a flow of the hydraulic fluid supplied to the boom cylinder 4. The arm directional control valve 26 controls a flow of the hydraulic fluid supplied to the arm cylinder 5, the bucket directional control valve 25 controls a flow of the hydraulic fluid supplied to the bucket cylinder 6, and the swing directional control valve 24 controls a flow of the hydraulic fluid supplied to the swing hydraulic motor 3.

While a case where the bucket directional control valve 25 is provided in the second pump line 21*b* and the arm directional control valve 26 is provided in the second pump line 21*c* is described by way of example, the bucket directional control valve 25 may be provided in the second pump line 21*c* and the arm directional control valve 26 may be provided in the second pump line 21*b*. Further, a case where the bucket directional control valve 25 as well as the boom directional control valve 22 is provided in the second pump line 21*b* and the arm directional control valve 26 as well as the boom directional control valve 23 is provided in the second pump line 21*c* is described by way of example. Alternatively, a travel directional control valve, for example, (not shown) controlling a flow of the hydraulic fluid supplied to each of the travel motors 32 (FIG. 1) may be provided as an alternative to the bucket directional control valve 25 and/or the arm directional control valve 26. In other words, the control valve device 2 is configured such that the second hydraulic pumps 2*b* and 2*c* drive the boom cylinder 4 and the travel motors 32.

Operation Levers

The operation levers 1*a* and 1*b* are operation devices instructing operations of the swing structure 9 and the work device 10. While electric levers are often used as the operation levers 1*a* and 1*b*, pilot lever devices are exemplarily shown as the operation levers 1*a* and 1*b* in the present embodiment.

The left operation lever 1*a* is a swing operation device instructing an operation of the swing hydraulic motor 3. When being operated in, for example, a horizontal direction, the left operation lever la delivers a left swing pilot pressure P1 or a right swing pilot pressure Pr in response to an operation direction (left operation direction or right operation direction), and outputs the left swing pilot pressure P1 or the right swing pilot pressure Pr to a pilot pressure receiving section of the swing directional control valve 24. When the left swing pilot pressure P1 is input to the swing directional control valve 24, then a position of the swing directional control valve 24 is changed over to a left-side position in FIG. 2, and the first pump line 21*a* is connected to a left-side supply line, in FIG. 2, of the swing hydraulic motor 3 to cause the swing structure 9 to swing leftward. Conversely, when the right swing pilot pressure Pr is input to the swing directional control valve 24, then the position of the swing directional control valve 24 is changed over to a right-side position in FIG. 2, and the swing hydraulic motor 3 reversely operates to cause the swing structure 9 to swing rightward. The left operation lever 1*a* also functions as another operation device that instructs an operation of another hydraulic actuator (the arm cylinder 5 in the present embodiment) which is other than the boom cylinder 4 and which is driven by the second hydraulic pump 2*c*. When being operated in, for example, a longitudinal direction, the left operation lever 1*a* delivers an arm dumping pilot pressure or an arm crowding pilot pressure in response to an operation direction (front or back operation direction), and outputs the arm dumping pilot pressure or the arm crowding pilot pressure to a pilot pressure receiving section of the arm directional control valve 26. The left swing pilot pressure P1, the right swing pilot pressure Pr, the arm dumping pilot pressure, and the arm crowding pilot pressure are pressure signals each having a magnitude in response to an operation amount of the left operation lever 1*a*. The operation direction of a swing operation and that of an arm operation may be interchanged with each other.

The right operation lever 1*b* is a boom operation device instructing an operation of the boom cylinder 4. When being operated in, for example, the longitudinal direction, the right operation lever 1*b* outputs a boom lowering pilot pressure Pd or a boom raising pilot pressure Pu in response to an operation direction (front or back operation direction), and outputs the boom lowering pilot pressure Pd or the boom raising pilot pressure Pu to pilot pressure receiving sections of the boom directional control valves 22 and 23. When the boom raising pilot pressure Pu is input, then positions of the boom directional control valves 22 and 23 are changed over to right-side positions in FIG. 2, the second pump lines 21*b* and 21*c* are connected to a bottom-side hydraulic chamber of the boom cylinder 4, and the boom cylinder 4 is expanded to raise the boom 35. Conversely, when the boom lowering pilot pressure Pd is input, then the positions of the boom directional control valves 22 and 23 are changed over to left-side positions in FIG. 2, and the boom cylinder 4 is contracted to lower the boom 35. The right operation lever 1*b* also serves as another operation device that instructs an operation of another hydraulic actuator (the bucket cylinder 6 in the present embodiment) which is other than the boom cylinder 4 and which is driven by the second hydraulic pump 2*b*. When being operated in, for example, the horizontal direction, the right operation lever 1*b* delivers a bucket dumping pilot pressure or a bucket crowding pilot pressure in response to an operation direction (left or right operation direction), and outputs the bucket dumping pilot pressure or the bucket crowding pilot pressure to a pilot pressure receiving section of the bucket directional control valve 25. The boom lowering pilot pressure Pd, the boom raising pilot pressure Pu, the bucket dumping pilot pressure, and the bucket crowding pilot pressure are pressure signals each having a magnitude in response to an operation amount of the right operation lever 1*b*. The operation direction of a boom operation and that of a bucket operation may be interchanged with each other.

Furthermore, the pilot pressures delivered from the operation levers 1*a* and 1*b* are output to the pump driving device 50 via the shuttle valve group in addition to the corresponding directional control valves. The pump driving device 50 controls tilting angles of the first hydraulic pump 2*a* and the second hydraulic pumps 2*b* and 2*c* by the pilot pressures and the like from the operation levers 1*a* and 1*b*. The pump driving device 50 will be described later.

Shuttle Valve Group

Figure 3:
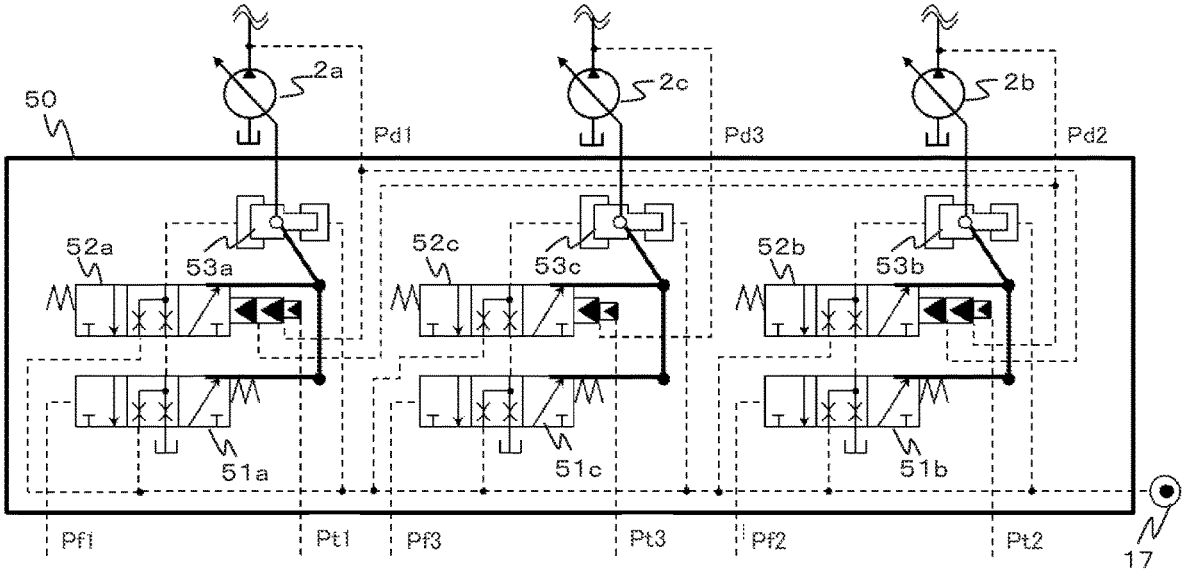
FIG. 3 is a circuit diagram of a pump driving device that constitutes the hydraulic system shown in FIG. 2.

The shuttle valve group is configured from shuttle valves 11*a* to 11*f*. The shuttle valve 11*a* supplies, as a first pump flow control pressure Pf1, a higher one of the right swing pilot pressure Pr and the left swing pilot pressure P1 to the pump driving device 50. The shuttle valve 11*b* supplies a higher one of the arm dumping pilot pressure and the arm crowding pilot pressure to the shuttle valve 11*c*. The shuttle valve 11*d* supplies a higher one of the boom raising pilot pressure Pu and the boom lowering pilot pressure Pd to the shuttle valves 11*c* and 11*e*. The shuttle valve 11*c* supplies, as a second pump flow control pressure Pf3, a higher one of the pilot pressures supplied from the shuttle valves 11*b* and 11*d* to the pump driving device 50. The shuttle valve 11*f* supplies a higher one of the bucket dumping pilot pressure and bucket crowding pilot pressure to the shuttle valve 11*e*. The shuttle valve 11*e* supplies, as a second pump flow control pressure Pf2, a higher one of the pilot pressures supplied from the shuttle valves 11*d* and 11*f* to the pump driving device 50. The first pump flow control pressure Pf1 is a command signal (positive control pressure) to a first pump displacement increase valve 51*a* (FIG. 3). Likewise, the second pump flow control pressure Pf3 is a command signal (positive control pressure) to a second pump displacement increase valve 51*c* (FIG. 3), and the second pump flow control pressure Pf2 is a command signal (positive control pressure) to a second pump displacement increase valve 51*b* (FIG. 3).

Operation Amount Detector

The operation amount detector includes a swing pilot pressure sensor 12, a boom raising pilot pressure sensor 13, and second pump flow control pressure sensors 14*a* and 14*b*. The swing pilot pressure sensor 12 is a swing operation amount detector that detects a swing operation amount (the left swing pilot pressure P1 or the right swing pilot pressure Pr in this example) of the left operation lever 1*a*, and is provided in a hydraulic line between the shuttle valve 11*a* and the pump driving device 50. The boom raising pilot pressure sensor 13 is a boom raising operation amount detector that detects a boom raising operation amount (the boom raising pilot pressure Pu in this example) of the right operation lever 1*b*, and is provided in a hydraulic line between the right operation lever 1*b* and the shuttle valve 11*d* in a boom raising pilot pressure output line. The second pump flow control pressure sensor 14*a* is a first maximum operation amount detector that detects a maximum value of a boom operation amount and a bucket operation amount (a first maximum operation amount, which is the second pump flow control pressure Pf2 in this example), and is provided in a hydraulic line between the shuttle valve 11*e* and the pump driving device 50. The second pump flow control pressure sensor 14*b* is a second maximum operation amount detector that detects a maximum value of the boom operation amount and the bucket operation amount (a second maximum operation amount, which is the second pump flow control pressure Pf3 in this example), and is provided in a hydraulic line between the shuttle valve 11*c* and the pump driving device 50.

Pump Control Valve

The pump control valve includes a pump flow control valve 15 and pump torque control valves 16*a* and 16*b*. The pump flow control valve 15 is a control valve that controls the first pump flow control pressure Pf1. This pump flow control valve 15 plays a role of controlling a delivery rate of the first hydraulic pump 2*a*, and is provided in the hydraulic line between the shuttle valve 11*a* and the pump driving device 50. The pump torque control valve 16*a* is a control valve that controls a first pump torque control pressure Pt1 (to be described later) and a second pump torque control pressure Pt2 (to be described later) input to the pump driving device 50. This pump torque control valve 16*a* plays a role of controlling absorption torques of the first hydraulic pump 2*a* and the second hydraulic pump 2*b*, and is provided in a hydraulic line between the pilot hydraulic fluid source 17 and the pump driving device 50. The pump torque control valve 16*b* is a control valve that controls a second pump torque control pressure Pt3 input to the pump driving device 50. The pump torque control valve 16*b* plays a role of controlling an absorption torque of the second hydraulic pump 2*c*, and is provided in the hydraulic line between the pilot hydraulic fluid source 17 and the pump driving device 50. The pump flow control valve 15 and the pump torque control valves 16*a* and 16*b* are each configured with a pressure reducing normally open valve.

Controller

The controller 100 computes and outputs a pump flow control valve command Sf1 and pump torque control valve commands St12 and St3 on the basis of the swing pilot pressure, the boom raising pilot pressure, and the second pump flow control pressures Pf2 and Pf3 input from the swing pilot pressure sensor 12, the boom raising pilot pressure sensor 13, and the second pump flow control pressure sensors 14*a* and 14*b* to drive the pump flow control valve 15 and the pump torque control valves 16*a* and 16*b*. The controller 100 will be described later in detail.

3. Pump Driving Device

FIG. 3 is a circuit diagram of the pump driving device 50. The pump driving device 50 shown in FIG. 3 includes the first pump displacement increase valve 51*a*, the second pump displacement increase valves 51*b* and 51*c*, a first pump displacement reduction valve 52*a*, second pump displacement reduction valves 52*b* and 52*c*, a first stroke constraint valve 53*a*, and second stroke constraint valves 53*b* and 53*c*. The first pump displacement increase valve 51*a*, the first pump displacement reduction valve 52*a*, and the first stroke constraint valve 53*a* are mechanically coupled to a swash plate of the first hydraulic pump 2*a* via a link and play a role of controlling a volume of the first hydraulic pump 2*a*. Likewise, the second pump displacement increase valve 51*b*, the second pump displacement reduction valve 52*b*, and the second stroke constraint valve 53*b* are mechanically coupled to a swash plate of the second hydraulic pump 2*b* via a link and play a role of controlling a volume of the second hydraulic pump 2*b*. The second pump displacement increase valve 51*c*, the second pump displacement reduction valve 52*c*, and the second stroke constraint valve 53*c* are mechanically coupled to a swash plate of the second hydraulic pump 2*c* via a link and play a role of controlling a volume of the second hydraulic pump 2*c*.

The first pump displacement increase valve 51*a* and the second pump displacement increase valves 51*b* and 51*c* are each urged by a spring from one side (right side in FIG. 3) and each include a pilot pressure receiving section on the other side (left side in FIG. 3). The first pump flow control pressure Pf1 is input to the pilot pressure receiving section of the first pump displacement increase valve 51*a*. When the first pump displacement increase valve 51*a* is thereby urged to the right side in FIG. 3, the volume of the first hydraulic pump 2*a* increases and a delivery rate thereof increases. Likewise, the second pump flow control pressures Pf2 and Pf3 are input to the pilot pressure receiving sections of the second pump displacement increase valves 51*b* and 51*c*. When the second pump displacement increase valves 51*b* and 51*c* are thereby urged to the right side in FIG. 3, delivery rates of the second hydraulic pumps 2*b* and 2*c* increase.

The first pump displacement reduction valve 52*a* and the second pump displacement reduction valves 52*b* and 52*c* each include a pilot pressure receiving section on one side (right side in FIG. 3) and are each urged by a spring from the other side (left side in FIG. 3). The first pump torque control pressure Pt1, a delivery pressure Pd1 of first hydraulic pump 2*a*, and a delivery pressure Pd2 of the second hydraulic pump 2*b* are input to the pilot pressure receiving section of the first pump displacement reduction valve 52*a*, thereby driving the first pump displacement reduction valve 52*a*. When the first displacement reduction valve 52*a* is urged to the left side in FIG. 3 by a total urging force of these pressures, then the delivery rate of the first hydraulic pump 2*a* decreases to limit the absorption torque of the first hydraulic pump 2*a*. Likewise, the second pump torque control pressure Pt2, the delivery pressure Pd1 of the first hydraulic pump 2*a*, and the delivery pressure Pd2 of the second hydraulic pump 2*b* are input to the pilot pressure receiving section of the second pump displacement reduction valve 52*b*, thereby driving the second pump displacement reduction valve 52*b*. When the second displacement reduction valve 52*b* is urged to the left side in FIG. 3 by a total urging force of these pressures, then the delivery rate of the second hydraulic pump 2*b* decreases to limit the absorption torque of the second hydraulic pump 2*b*. The second pump torque control pressure Pt3 and the delivery pressure Pd3 of the second hydraulic pump 2*c* are input to the pilot pressure receiving section of the second pump displacement reduction valve 52*c*. When the second pump displacement reduction valve 52*c* is urged to the left side in FIG. 3 by a total urging force by these pressures, the absorption torque of the second hydraulic pump 2*c* is limited.

Furthermore, a pressure of the pilot hydraulic fluid source 17 directly acts on a right side in FIG. 3 of the second stroke constraint valve 53*b*, while a pilot pressure of the pilot hydraulic fluid source 17 reduced by the second pump displacement increase valve 51*b* and the second pump displacement reduction valve 52*b* acts on left side in FIG. 3 of the second stroke constraint valve 53*b*. When the second pump displacement increase valve 51*b*, the second pump displacement reduction valve 52*b*, and the second stroke constraint valve 53*b* move to the right side in FIG. 3, then the pressure acting on the left side in FIG. 3 of the second stroke constraint valve 53*b* decreases. When the second pump displacement increase valve 51*b*, the second pump displacement reduction valve 52*b*, and the second stroke constraint valve 53*b* move to the left side in FIG. 3, then the pressure acting on the right side in FIG. 3 of the second stroke constraint valve 53*b* decreases. In other words, a restoring force in response to a difference between the pressures acting on the two sides acts on the second stroke constraint valve 53*b*, thereby suppressing movements of the second pump displacement increase valve 51*b*, the second pump displacement reduction valve 52*b*, and the second stroke constraint valve 53*b*, and keeping constant the delivery rate of the second hydraulic pump 2*b* under the same pressure conditions. The first stroke constraint valve 53*a* and the second stroke constraint valve 53*c* have configurations similar to that of the second stroke constraint valve 53*b* and function similarly to the second stroke constraint valve 53*b*.

4. Controller

Figure 4:
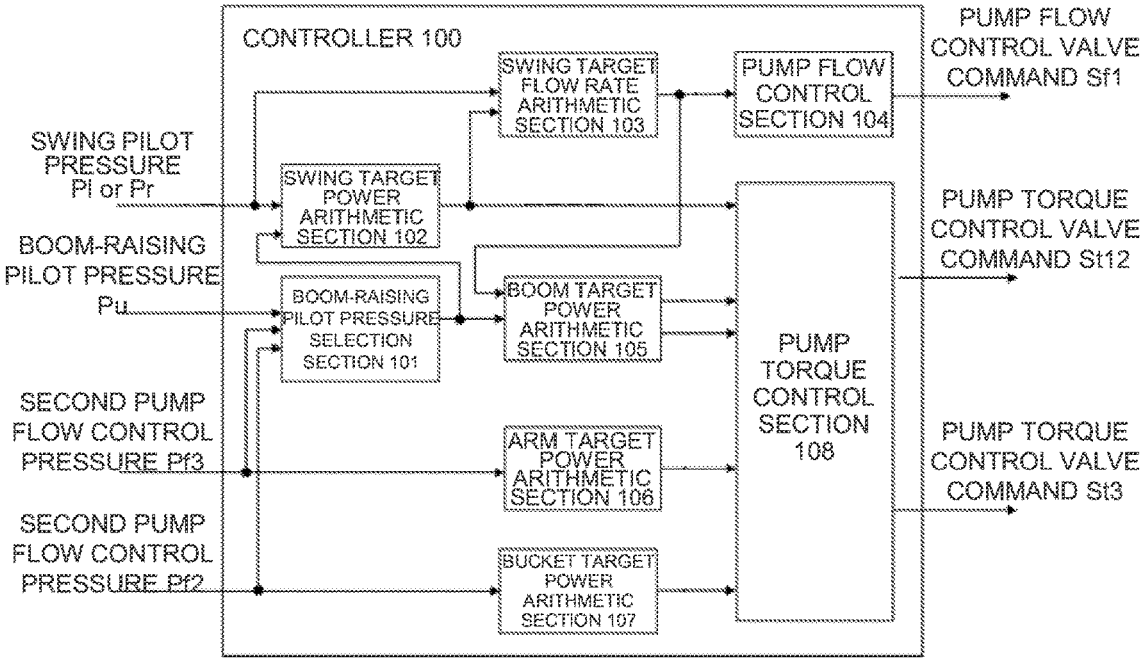
FIG. 4 is a functional block diagram of a controller that constitutes the hydraulic system shown in FIG. 2.

FIG. 4 is a functional block diagram of the controller 100. The controller 100 shown in FIG. 4 includes a boom-raising pilot pressure selection section 101, a swing target power arithmetic section 102, a swing target flow rate arithmetic section 103, a pump flow control section 104, a boom target power arithmetic section 105, an arm target power arithmetic section 106, a bucket target power arithmetic section 107, and a pump torque control section 108. The respective functional sections will be described below.

4-1. Boom-Raising Pilot Pressure Selection Section

Figure 5:
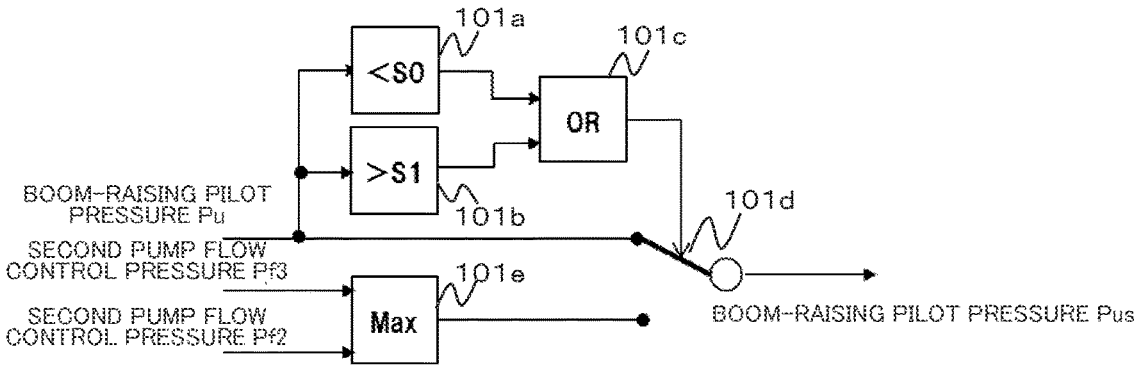
FIG. 5 is a circuit diagram of a boom raising pilot pressure selection section that constitutes the controller shown in FIG. 4.

FIG. 5 is a circuit diagram of the boom-raising pilot pressure selection section 101. As shown in FIG. 5, the boom-raising pilot pressure selection section 101 includes determiners 101*a* to 101*c*, a switch 101*d*, and a selector 101*e*. The determiners 101*a* to 101*c* are functional sections that determine whether a failure occurs in the boom raising pilot pressure sensor 13. Specifically, the determiner 101*a* determines whether the boom raising pilot pressure Pu detected by the boom raising pilot pressure sensor 13 is lower than a predetermined lower limit threshold S0, the determiner 101*b* determines whether the boom raising pilot pressure Pu is higher than a predetermined upper limit threshold S1 (<S0), and the determiner 101*c* determines that a failure occurs in the boom raising pilot pressure sensor 13 when any of two determinations is true (that is, Pu does not satisfy S1<Pu<S0). The switch 101*d* is changed over in response to an output from the determiner 101*c* and when it is determined that the boom raising pilot pressure sensor 13 is normal (Pu satisfies S1<Pu<S0), the switch 101*d* selects the boom raising pilot pressure Pu and outputs the boom raising pilot pressure Pu as a boom raising pilot pressure Pus. Conversely, when it is determined that the boom raising pilot pressure sensor 13 fails (Pu satisfies Pu≤S1 or S0≤Pu), the switch 101*d* is changed over and an output from the selector 101*e* is output as the boom raising pilot pressure Pus. The output from the selector 101*e* is a higher one of the second pump flow control pressures Pf2 and Pf3. The boom raising pilot pressure Pus is output to the swing target power arithmetic section 102 and the boom target power arithmetic section 105.

4-2. Swing target power arithmetic section

Figure 6:
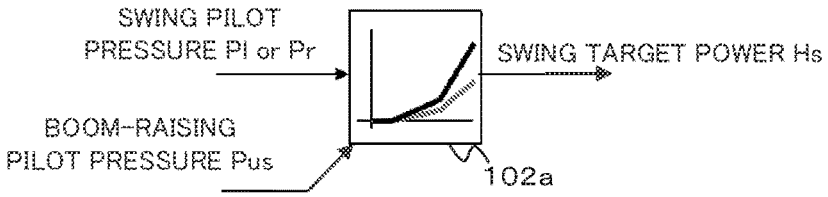
FIG. 6 is a circuit diagram of a swing target power arithmetic section that constitutes the controller shown in FIG. 4.

FIG. 6 is a circuit diagram of the swing target power arithmetic section 102. The swing target power arithmetic section 102 is a functional section that computes target power of the swing hydraulic motor 3 (hereinafter, referred to as "swing target power Hs") from the swing pilot pressure P1 or Pr and the boom raising pilot pressure Pus. This swing target power arithmetic section 102 makes a correction in such a manner as to increase the swing target power Hs as the swing pilot pressure P1 or Pr is higher and to reduce the swing target power Hs as the boom raising pilot pressure Pus is higher. Specifically, the swing target power arithmetic section 102 computes the swing target power Hs from the swing pilot pressure P1 or Pr using a map 102*a*. A plurality of relationships between the swing pilot pressure P1 or Pr and the swing target power Hs in the map 102*a* are prepared in accordance with the boom raising pilot pressure Pus, and the computed swing target power Hs for the swing pilot pressure P1 or Pr becomes lower as the boom raising pilot pressure Pus is higher. The swing target power Hs is output to the swing target flow rate arithmetic section 103 and the pump torque control section 108.

4-3. Swing Target Flow Rate Arithmetic Section

Figure 7:
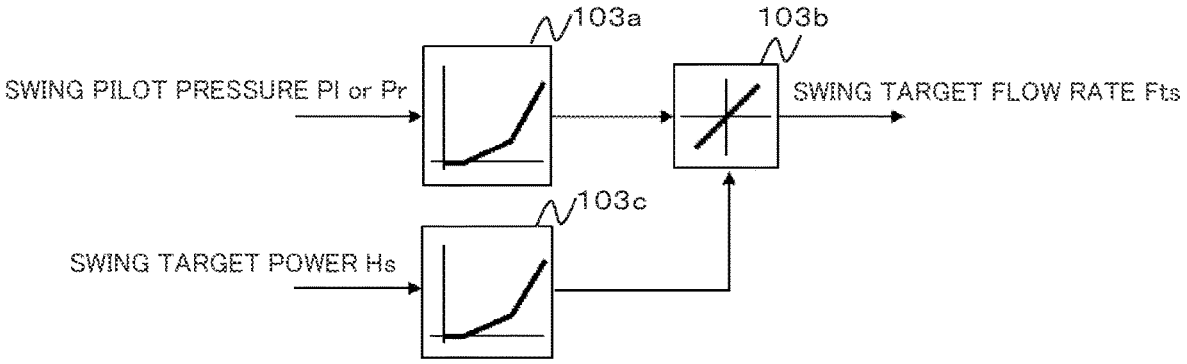
FIG. 7 is a circuit diagram of a swing target flow rate arithmetic section that constitutes the controller shown in FIG. 4.

FIG. 7 is a circuit diagram of the swing target flow rate arithmetic section 103. The swing target flow rate arithmetic section 103 is a functional section that computes a target flow rate of the first hydraulic pump 2*a* (hereinafter, referred to as "swing target flow rate Fts") from the swing pilot pressure P1 or Pr and the swing target power Hs. This swing target flow rate arithmetic section 103 makes a correction in such a manner as to increase the swing target flow rate Fts as the swing pilot pressure P1 or Pr is higher and to reduce an increasing rate of the swing target flow rate Fts as the swing target power Hs input from the swing target power arithmetic section 102 is lower. Specifically, the swing target flow rate arithmetic section 103 includes maps 103*a* and 103*c* and a rate limiter 103*b*. When the swing pilot pressure P1 or Pr is input, the swing target flow rate arithmetic section 103 generates a swing reference flow rate in response to the swing pilot pressure P1 or Pr using the map 103*a*. An increasing rate of this swing reference flow rate is limited by the rate limiter 103*b* to be computed as the swing target flow rate Fts. A limit value used in the rate limiter 103*b* is a value computed from the swing target power Hs using the map 103*c*. The map 103*c* makes setting in such a manner as to increase the increasing rate of the swing target flow rate Fts as the swing target power Hs is higher. Since the swing target power arithmetic section 102 computes the swing target power Hs in such a manner as to reduce the swing target power Hs as the boom raising pilot pressure Pus is higher, the increasing rate of the swing target flow rate Fts becomes lower as the boom raising pilot pressure Pus is higher. The swing target flow rate Fts computed by the swing target flow rate arithmetic section 103 is output to the pump flow control section 104 and the boom target power arithmetic section 105.

4-4. Pump Flow Control Section

Figure 8:
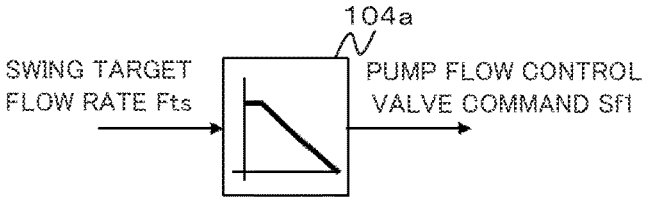
FIG. 8 is a circuit diagram of a pump flow control section that constitutes the controller shown in FIG. 4.

FIG. 8 is a circuit diagram of the pump flow control section 104. The pump flow control section 104 is a functional section that controls the delivery rate of the first hydraulic pump 2*a* in response to the swing target flow rate Fts input from the swing target flow rate arithmetic section 103. Specifically, the pump flow control section 104 computes the pump flow control valve command Sf1 described above from the target flow rate Fts using a map 104*a*, and outputs the pump flow control valve command Sf1 to the pump flow control valve 15. The map 104*a* makes setting such that the pump flow control valve command Sf1 becomes smaller and a delivery pressure of the pump flow control valve 15 becomes higher as the swing target flow rate Fts is higher.

4-5. Boom Target Power Arithmetic Section

Figure 9:
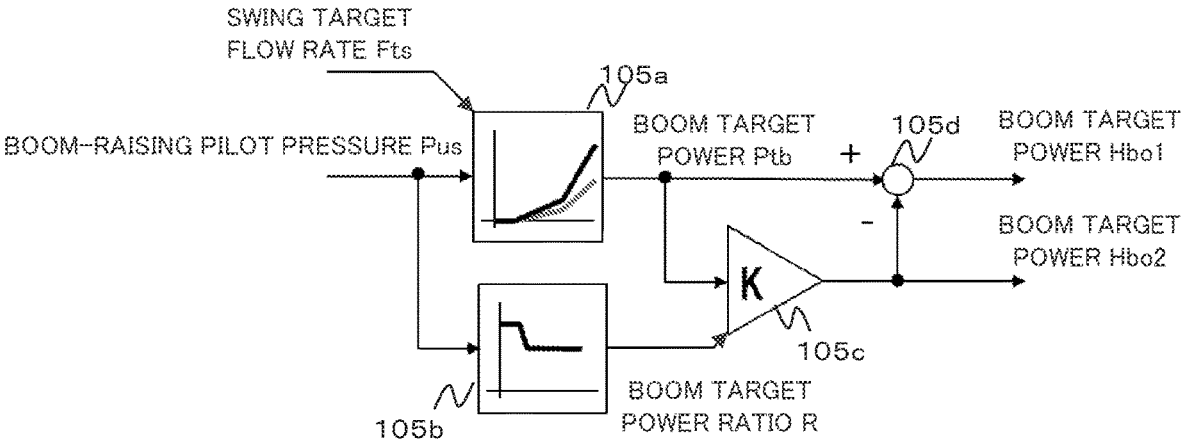
FIG. 9 is a circuit diagram of a boom target power arithmetic section that constitutes the controller shown in FIG. 4.

FIG. 9 is a circuit diagram of the boom target power arithmetic section 105. The boom target power arithmetic section 105 is a functional section that computes boom target power Hbo1 and Hbo2 from the boom raising pilot pressure Pus computed by the boom-raising pilot pressure selection section 101 and the swing target flow rate Fts computed by the swing target flow rate arithmetic section 103, and includes maps 105*a* and 105*b*, a multiplier 105*c*, and a subtracter 105*d*. When the boom raising pilot pressure Pus and the swing target flow rate Fts are input, the boom target power arithmetic section 105 generates boom target power Hbo. The map 105*a* makes setting to make a correction in such a manner as to increase the boom target power Hbo as the boom raising pilot pressure Pus is higher and to reduce the boom target power Hbo as the swing target flow rate Fts is higher. For example, a plurality of relationships between the boom raising pilot pressure Pus and the boom target power Hbo in the map 105*a* are prepared in accordance with the swing target flow rate Fts, and the map 105*a* makes setting in such a manner as to decrease the boom target power Hbo to be computed for the boom raising pilot pressure Pus as the swing target flow rate Fts is higher. At the same time, the boom target power arithmetic section 105 computes a boom target power ratio R from the boom raising pilot pressure Pus using the map 105*b*. The boom target power ratio R is multiplied by the boom target power Hbo in the multiplier 105*c*, and a value obtained by multiplying the boom target power Hbo by the boom target power ratio R is computed as boom target power Hbo2 that is a target torque of the boom cylinder 4 assigned to the second hydraulic pump 2*c*. In addition, a value obtained by subtracting boom target power Hbo2 from the boom target power Hbo in the subtracter 105 is computed as boom target power Hbo1 that is a target torque of the boom cylinder 4 assigned to the second hydraulic pump 2*b*. A characteristic of the map 105*b* may be defined, for example, in such a manner as to increase the boom target power ratio R as an opening area of the boom directional control valve 23 is larger on the basis of a ratio of opening areas of the boom directional control valve 22 and 23 to the boom raising pilot pressure Pus. The boom target power Hbo1 and Hbo2 is output to the pump torque control section 108.

4-6. Arm Target Power Arithmetic Section

Figure 10:
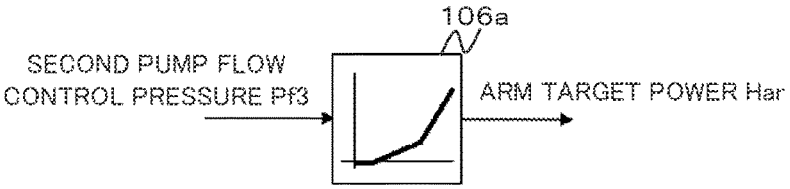
FIG. 10 is a circuit diagram of an arm target power arithmetic section that constitutes the controller shown in FIG. 4.

FIG. 10 is a circuit diagram of the arm target power arithmetic section 106. The arm target power arithmetic section 106 is a functional section that computes arm target power Har on the basis of a detection signal of the second pump flow control pressure Pf3 from the second pump flow control pressure sensor 14*b*. The arm target power arithmetic section 106 in the present embodiment computes the arm target power Har in response to the second pump flow control pressure Pf3 using a map 106*a*. The computed arm target power Har is output to the pump torque control section 108.

4-7. Bucket Target Power Arithmetic Section

Figure 11:
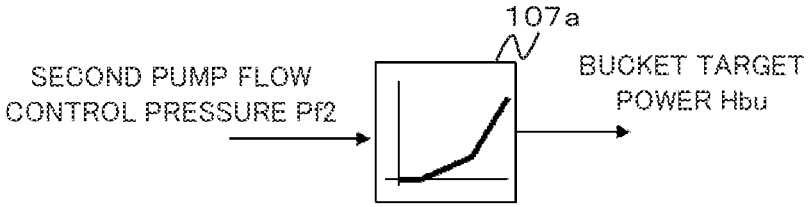
FIG. 11 is a circuit diagram of a bucket target power arithmetic section that constitutes the controller shown in FIG. 4.

FIG. 11 is a circuit diagram of the bucket target power arithmetic section 107. The bucket target power arithmetic section 107 is a functional section that computes bucket target power Hbu on the basis of a detection signal of the second pump flow control pressure Pf2 from the second pump flow control pressure sensor 14*a*. The bucket target power arithmetic section 107 in the present embodiment computes the bucket target power Hbu in response to the second pump flow control pressure Pf2 using a map 107*a*. The computed bucket target power Hbu is output to the pump torque control section 108.

4-8. Pump Torque Control Section

Figure 12:
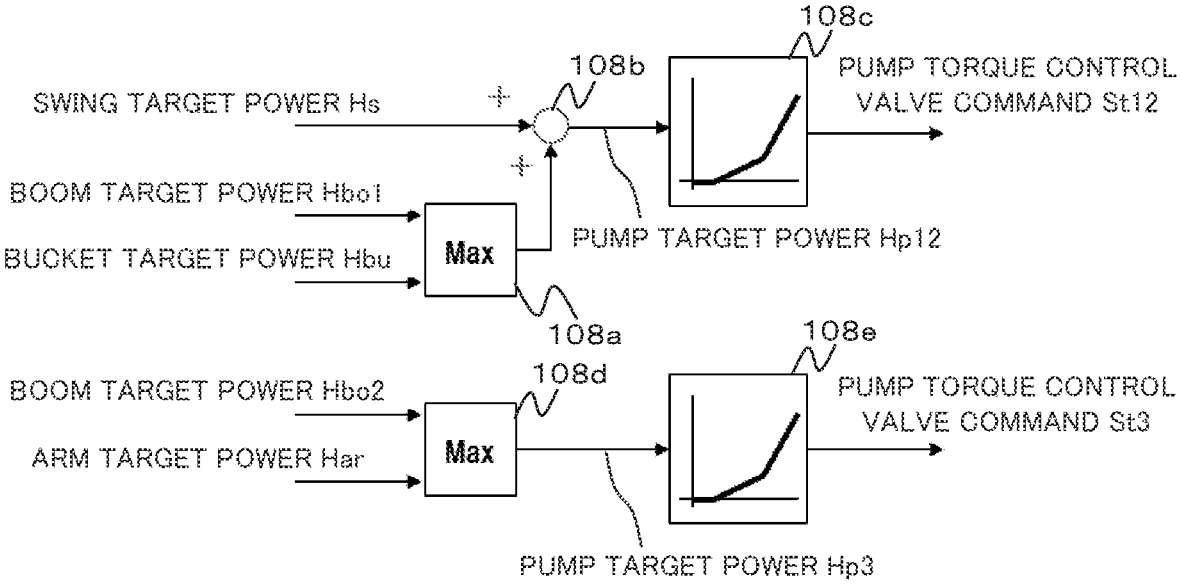
FIG. 12 is a circuit diagram of a pump torque control section that constitutes the controller shown in FIG. 4.

FIG. 12 is a circuit diagram of the pump torque control section 108. The pump torque control section 108 includes selectors 108*a* and 108*d*, an adder 108*b*, and maps 108*c* and 108*e*. This pump torque control section 108 is a functional section that computes the pump torque control valve command St12 to the pump torque control valve 16*a* on the basis of the swing target power Hs, the boom target power Hbo1, and the bucket target power Hb that are previously computed. At the same time, the pump torque control section 108 is a functional section that computes the pump torque control valve command St3 to the pump torque control valve 16*b* on the basis of the boom target power Hbo2 and the arm target power Har.

When the boom target power Hbo1 and the bucket target power Hbu are input, higher power of the boom target power Hbo1 and the bucket target power Hbu is selected in the selector 108*a*, and the selected power is added to the swing target power Hs in the adder 108*b* to compute pump target power Hp12. When the pump target power Hp12 is computed, the pump torque control valve command St12 in response to the pump target power Hp12 is computed using the map 108*c* and output to the pump torque control valve 16*a*.

On the other hand, when the boom target power Hbo2 and the arm target power Har are input, higher power of the boom target power Hbo2 and the arm target power Har is selected as pump target power Hp3 in the selector 108*d*. When the pump target power Hp3 is set, the pump torque control valve command St3 in response to the pump target power Hp3 is computed using the map 108*e* and output to the pump torque control valve 16*b*.

The maps 108*c* and 108*e* make setting in such a manner as to increase the pump torque control valve commands St12 and St3 and reduce the delivery pressures (that is, the first pump torque control pressure Pt1 and the second pump torque control pressures Pt2 and Pt3) of the pump torque control valves 16*a* and 16*b* as the pump target power Hp12 and Hp3 is higher. As the configuration of the pump driving device 50 is previously described, when the delivery pressure of the pump torque control valve 16*a* becomes lower, the delivery rates of the second hydraulic pump 2*b* and the first hydraulic pump 2*a* increase, and when the delivery pressure of the pump torque control valve 16*b* becomes lower, the delivery rate of the second hydraulic pump 2*c* increases.

5. Effect (1) Excellent Combined Operability

According to the hydraulic system configured as described above, the swing target power Hs computed by the swing target power arithmetic section 102 becomes higher as the swing operation amount (that is, the swing pilot pressure P1 or Pr) is larger. In this case, during the swing boom raising operation (that is, when the swing pilot pressure P1 or Pr and the boom raising pilot pressure Pu are simultaneously input to the controller 100), the swing target power Hs is calculated to be corrected to be lower than a value in response to the swing operation amount as the boom raising operation amount (that is, the boom raising pilot pressure Pus) is larger. The increasing rate of the swing target flow rate Fts computed by the swing target flow rate arithmetic section 103 is corrected to be lower than a value in response to the swing operation amount as the swing target power Hs is lower. As a result, during the swing boom raising, the swing acceleration becomes lower as the boom raising operation amount is larger, compared with a case of the sole swing operation. Therefore, "excellent combined operability" is attained during the swing boom raising operation.

(2) Energy Efficiency

Since the swing hydraulic motor 3 and the boom cylinder 4 are driven by the different hydraulic pumps (the first hydraulic pump 2*a* and the second hydraulic pumps 2*b* and 2*c*), it is possible to suppress the divergence loss that may be generated in the configuration of driving the swing hydraulic motor and the boom cylinder by the common hydraulic pump. Furthermore, since the delivery rate of the first hydraulic pump 2*a* is controlled in response to not only the swing operation amount but also the boom raising operation amount, it is possible to suppress degradation of fuel economy without increasing a pressure loss between the first and second hydraulic pumps 2*b* and 2*c* and the boom cylinder 4 at a time of adjusting the swing speed.

(3) Reliability

If the determiners 101*a* to 101*c* determine that a failure occurs in the boom raising pilot pressure sensor 13, the higher signal of the second pump flow control pressures Pf2 and Pf3 is output, as an alternative signal to the boom raising pilot pressure Pu, from the boom-raising pilot pressure selection section 101, as described above. As is obvious from a connection relationship among the shuttle valves 11*b* to 11*f*, the boom raising pilot pressure Pu is one of candidates of the second pump flow control pressures Pf2 and Pf3 and, therefore, the second pump flow control pressures Pf2 and Pf3 are generated when the boom raising operation is performed. Therefore, inputting the second pump flow control pressures Pf2 and Pf3 to the boom-raising pilot pressure selection section 101 makes it possible to detect that there is a probability that the boom raising operation has been performed even if a failure occurs in the boom raising pilot pressure sensor 13. Owing to this, even if a failure occurs in the boom raising pilot pressure sensor 13, it is possible to ensure the excellent combined operability during the swing boom raising operation by using the second pump flow control pressure Pf2 or Pf3 as an alternative to the boom raising pilot pressure Pus.

Furthermore, the hydraulic system is configured such that the delivery pressure Pd2 of the second hydraulic pump 2*b* acts on the first pump displacement reduction valve 52*a*. In other words, when the boom raising operation is performed and the boom cylinder 4 communicates with the second hydraulic pump 2*b*, a load pressure of the boom cylinder 4 acts on the first pump displacement reduction valve 52*a* as the delivery pressure Pd2 of the second hydraulic pump 2*b*. Therefore, whether a failure occurs in the boom raising pilot pressure sensor 13, by causing the load pressure of the boom cylinder 4 to act on the first pump displacement reduction valve 52*a* during the swing boom raising operation, it is possible to suppress the delivery rate of the first hydraulic pump 2*a* and suppress the swing acceleration. In this respect, it is possible to ensure the excellent combined operability.

(4) Others

The map 105*a* in the boom target power arithmetic section 105 makes setting in such a manner as to reduce the computed boom target power Hbo for the boom raising pilot pressure Pus as the swing target flow rate Fts is higher, as described above. It is thereby possible to slow down the boom raising speed when the swing speed increases and a swing load pressure decreases at the time of the swing boom raising operation. This can also contribute to improving the combined operability.

6. Alternatives

While the case of using the pilot operation levers 1*a* and 1*b* is taken as an example in the present embodiment, electric levers may be used as various types of operation devices such as the swing operation device and the boom operation device. If the electric levers are used as the swing operation device and the boom operation device, the pump flow control valve 15 and the pump torque control valves 16*a* and 16*b* can be omitted. Moreover, in the operation amount detector, potentiometers that directly detect electric lever operation amounts, for example, can be used as an alternative to the swing pilot pressure sensor 12, the boom raising pilot pressure sensor 13, and the like. In this case, if each potentiometer is configured, for example, such that the pilot pressure of the pilot hydraulic fluid source 17 (or another pilot hydraulic fluid source) is reduced by a solenoid valve similarly to the first pump torque control pressure Pt1 and the second pump torque control pressures Pt2 and Pt3, the solenoid valve is controlled by a command signal computed by the controller 100 on the basis of a signal of the potentiometer, and control pressure signals corresponding to the first pump flow control pressure Pf1 and the second pump flow control pressures Pf2 and Pf3 are generated, it is possible to realize similar functions to those of the embodiment described above.

Moreover, if the electric levers are used as the swing operation device and the boom operation device, the hydraulic system may be possibly configured such that the pump flow control valve 15 and the pump torque control valves 16*a* and 16*b* are omitted, electromagnetically-driven valves are used as the first pump displacement increase valve 51*a* and the second pump displacement increase valves 51*b* and 51*c*, and electromagnetic pilot valves are used as the first pump displacement reduction valve 52*a* and the second pump displacement reduction valves 52*b* and 52*c*. In this case, if the hydraulic system is configured such that control pressure signals corresponding to the first pump flow control pressure Pf1, the second pump flow control pressures Pf2 and Pf3, the first pump torque control pressure Pt1, and the second pump torque control pressures Pt2 and Pt3 are computed by the controller 100 on the basis of the signals of the potentiometers, and the control pressure signals are output to solenoid drive sections of the first pump displacement increase valve 51*a*, the second pump displacement increase valves 51*b* and 51*c*, the first pump displacement reduction valve 52*a*, and the second pump displacement reduction valves 52*b* and 52*c*, it is possible to realize similar functions to those of the embodiment described above.

DESCRIPTION OF REFERENCE CHARACTERS

1*a*: Left operation lever (swing operation device, another operation device)
1*b*: Right operation lever (boom operation device, another operation device)
2*a*: First hydraulic pump
2*b*, 2*c*: Second hydraulic pump
3: Swing hydraulic motor
4: Boom cylinder
5: Arm cylinder (another hydraulic actuator)
6: Bucket cylinder (another hydraulic actuator)
8: Track structure
9: Swing structure
10: Work device
12: Swing pilot pressure sensor (swing operation amount detector)
13: Boom raising pilot pressure sensor (boom raising operation amount detector)
14*a*, 14*b*: Second pump flow control pressure sensor (maximum operation amount detector)
15: Pump flow control valve
35: Boom
51*a*: First pump displacement increase valve
52*a*: First pump displacement reduction valve
100: Controller
101*a*-101*c*: Determiner
101*d*: Switch
102: Swing target power arithmetic section
103: Swing target flow rate arithmetic section
104: Pump flow control section
Fts: Swing target flow rate
Hs: Swing target power
Pf1: First pump flow control pressure (first pump flow control signal)
Pf2, Pf3: Second pump flow control pressure (maximum operation amount)
P1, Pr: Swing pilot pressure (swing operation amount)
Pu, Pus: Boom raising pilot pressure (boom raising operation amount)
Sf1: Pump flow control valve command

The invention claimed is:

1. A hydraulic system for a work machine, the work machine including a track structure, a swing structure swingably mounted on the track structure, and a work device that includes a boom attached to the swing structure, the hydraulic system comprising:

a swing hydraulic motor causing the swing structure to swing;

a boom cylinder driving the boom;

a first hydraulic pump delivering a hydraulic fluid for driving the swing hydraulic motor;

a second hydraulic pump delivering a hydraulic fluid for driving the boom cylinder;

a swing operation device instructing an operation of the swing hydraulic motor;

a boom operation device instructing an operation of the boom cylinder;

a first pump displacement increase valve controlling a volume of the first hydraulic pump;

a swing operation amount detector detecting a swing operation amount of the swing operation device;

a boom raising operation amount detector detecting a boom raising operation amount of the boom operation device;

a pump flow control valve generating a first pump flow control signal; and a controller controlling the first pump flow control signal to the first pump displacement increase valve on the basis of the swing operation amount detected by the swing operation amount detector and the boom raising operation amount detected by the boom raising operation amount detector, wherein:

the controller controls the first pump flow control signal in such a manner that a delivery rate of the first hydraulic pump becomes higher as the swing operation amount of the swing operation device is larger and an increasing rate of the delivery rate of the first hydraulic pump becomes lower as the boom raising operation amount of the boom operation device is larger if a swing operation by the swing operation device and a boom raising operation by the boom operation device are performed simultaneously, the controller comprises a swing target power arithmetic section computing swing target power that is target power of the swing hydraulic motor; a swing target flow rate arithmetic section computing a swing target flow rate that is a target flow rate of the first hydraulic pump; and a pump flow control section computing and outputting a pump flow control valve command that is a command signal to the pump flow control valve, the swing target power arithmetic section makes a correction in such a manner as to increase the swing target power as the swing operation amount of the swing operation device is larger and to reduce the swing target power as the boom raising operation amount of the boom operation device is larger, the swing target flow rate arithmetic section makes a correction in such a manner as to increase the swing target flow rate as the swing operation amount of the swing operation device is larger and to reduce an increasing rate of the swing target flow rate as the swing target power is lower, and the pump flow control section computes the pump flow control valve command on the basis of the swing target flow rate input from the swing target flow rate arithmetic section.

2. The hydraulic system for a work machine according to claim 1, further comprising:

another hydraulic actuator that is driven by the hydraulic fluid delivered from the second hydraulic pump and that is a hydraulic actuator other than the boom cylinder;

another operation device instructing an operation of the another hydraulic actuator;

a maximum operation amount detector detecting a maximum operation amount that is a maximum value of the boom raising operation amount of the boom operation device and an operation amount of the another operation device;

a determiner determining a failure in the boom raising operation amount detector; and a switch that is changed over by an output from the determiner and that outputs the maximum operation amount to the swing target power arithmetic section as the boom raising operation amount of the boom operation device if it is determined that a failure occurs in the boom raising operation amount detector.

3. The hydraulic system for a work machine according to claim 2, further comprising:

a first pump displacement reduction valve that is driven by delivery pressures of the first hydraulic pump and the second hydraulic pump and that operates in such a manner as to limit an absorption torque of the first hydraulic pump.

* * * * *